US005139007A

United States Patent [19]

Martinez

[11] Patent Number: 5,139,007

[45] Date of Patent: Aug. 18, 1992

[54] GLASS-CERAMIC GAS COOKER TOP WITH GLOWING FILAMENT INDICATOR OF LIT PILOT LIGHT VISIBLE THROUGH PLATE

[75] Inventor: Francisco Bertomeu Martinez, Sedavi, Spain

[73] Assignees: Catalana De Gas, S.A., Barcelona; Sergio V. Sospedra, Valencia, both of Spain

[21] Appl. No.: 628,952

[22] Filed: Dec. 11, 1990

[30] Foreign Application Priority Data

Dec. 11, 1989 [ES] Spain ..... 8904176

[51] Int. Cl.[5] ..... F24C 3/00

[52] U.S. Cl. ..... 126/39 J; 126/39 D; 126/39 G

[58] Field of Search ..... 126/39 D, 39 G, 39 H, 126/39 N, 39 J, 39 K

[56] References Cited

U.S. PATENT DOCUMENTS

| | | | |
|---|---|---|---|
| 3,241,542 | 3/1966 | Lotter | 126/39 J |
| 3,830,216 | 8/1974 | Dodd | 126/39 J |
| 4,083,355 | 4/1978 | Schwank | 126/39 J |
| 4,201,184 | 5/1980 | Scheidler et al. | 126/39 J |
| 4,580,550 | 4/1986 | Kristen et al. | 126/39 H |
| 4,917,075 | 4/1990 | Atmella . | |

FOREIGN PATENT DOCUMENTS

| | | | |
|---|---|---|---|
| 0124022 | 11/1984 | European Pat. Off. . | |
| 3102124 | 8/1982 | Fed. Rep. of Germany | 126/39 J |
| 2158749 | 6/1973 | France . | |
| 2282604 | 3/1976 | France . | |
| 2364408 | 4/1978 | France . | |

*Primary Examiner*—Carroll B. Dority

*Attorney, Agent, or Firm*—Cushman, Darby & Cushman

[57] ABSTRACT

A glass-ceramic gas cooker top is provided with a piezoelectrically operated igniter for a pilot light for the burner. When the pilot light is lit, it heats a filament that is visible through the cooking vessel support plate of the cooker top. The burner is provided with a thermostatic valve, having a temperature-sensing bulb applied to the underside of the cooking vessel support plate.

2 Claim, 3 Drawing Sheets

GLASS-CERAMIC GAS COOKER TOP WITH GLOWING FILAMENT INDICATOR OF LIT PILOT LIGHT VISIBLE THROUGH PLATE

BACKGROUND OF THE INVENTION

The present invention relates to improvements in gas cooker tops.

Current cookers, known as glass-ceramic gas cooker tops, use by way of a means or element of control, electronic systems dependent on electric power. This means that two energy sources, gas and electricity are necessary for the apparatus to function.

In this invention, the cooker top uses only gas as an energy source.

Known cookers are not equipped with a tap or thermostatic valve which controls each burner and allows the rapid on/off opening and closing of the gas flow at the same time as limiting the maximum temperature which the glass-ceramic plate being used is capable of reaching.

SUMMARY OF THE INVENTION

The gas-ceramic gas cooker top of the present invention uses a tap or thermostatic valve with the above indicated functions and also carries these functions out in various positions of use, permitting the variation of the functioning time of the burner being controlled, from an extremely low minimum to the maximum established for use, offering the user a wide range of cooking or heating temperatures for different types of food.

Another advantage of the gas-ceramic gas cooker top of this invention is it can be clearly seen from the plate (i.e., from externally, above the glass-ceramic plate of the cooker top). whether or not the lighting operation has been correctly carried out, before discharging gas to the burner to be used. That is to say, before the burner can be lit, there is a prior operation of lighting a permanent flame or pilot light.

The visual display of the lighting of the flame consists of the heating of an element with the flame, this element being a heat-resistant filament, which begins to glow and lights up quickly, being easily visible by the user through the glass-ceramic plate.

The permanent nature of this device is a safety feature, since it stops the output of gas by the burner and subsequent lighting, for so long as the permanent flame remains unlit, thus avoiding gas build-up.

Lighting gas can give rise to mild or noisy explosions. If the permanent flame is not lit, the safety system based on thermocouple and magnetic units included in each thermostatic valve, will not work. As a result, the valve will remain closed, obstructing all gas output.

The thermostatic valve of each burner is equipped with a sensory element situated below and in contact with the glass-ceramic plate.

The sensory element is a bulb whose contact with the plate is carried out through a flat and/or curved-convex arched surface, or directly through the flat or curved-convex form proper to said bulb.

When the temperature selected thermostatically in the sensory element has been reached, the element cancels the flow of gas to the burner by means of the expansion of a liquid in the inside of the bulb. At the far opposite end of the bulb is a flexible formation, housed in a tubular unit.

This formation places pressure on, and axially displaces elastically controlled internal elements which modify the position of a non-rigid metallic membrane which, according to the direction of the liquid expansion, becomes deformed in such a way as to adopt a curved-convex position, thereby freeing the shaft of an internal valve, which through an axial spring, closes the gas flow to the cooker top burner.

When the temperature of the sensory element falls sufficiently, the liquid contracts and inverts the membrane deformation, facilitating the opening of the internal valve, which permits gas to flow to the burner.

The above function produces an alternative gas stream which operates on a maximum flow or no flow basis, known as on/off.

When the thermostatic valve is used for at least two burners, an intercommunication is set up in the valve, which permits gas flow, in such a way that the thermostat acts simultaneously and without differentiating on the two burners.

BRIEF DESCRIPTION OF THE DRAWINGS

Following is a description of a non-definitive practical example of the invention, with reference to the accompanying drawings, in which.

DETAILED DESCRIPTION

Figure 1:
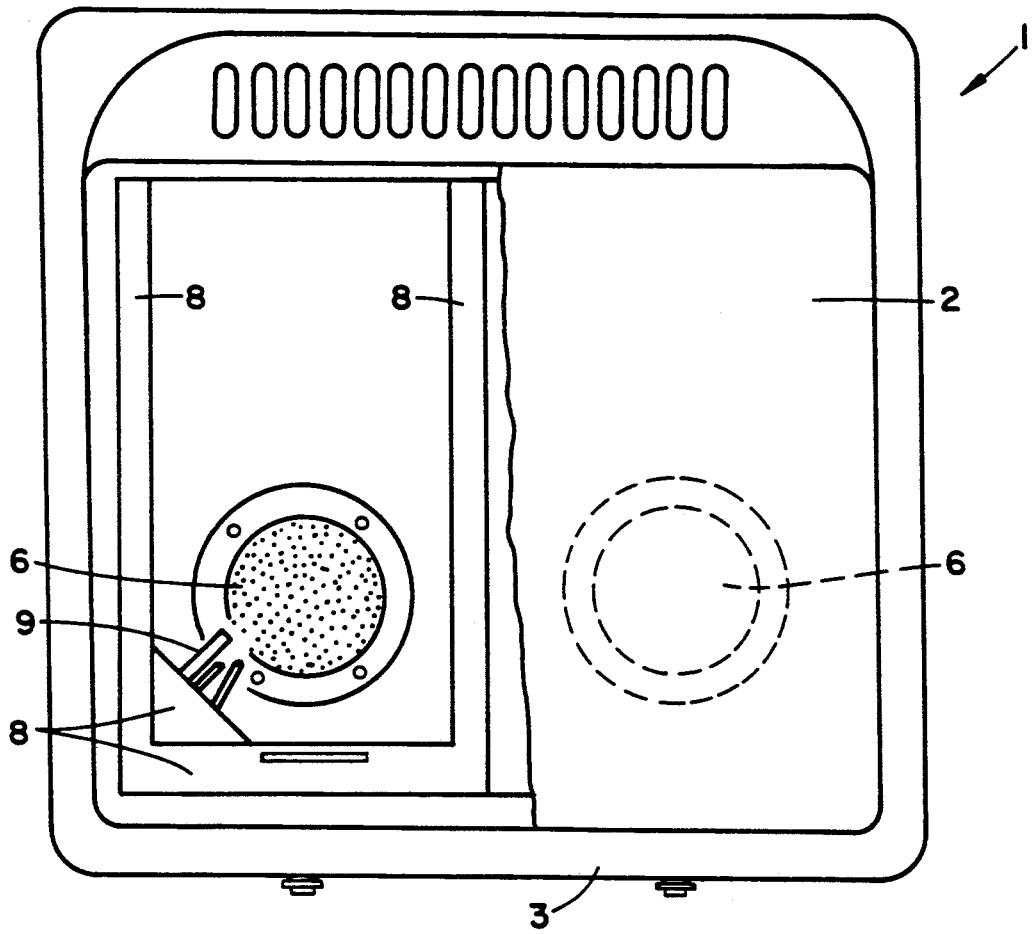
FIG. 1 shows in top plan view a glass-ceramic gas cooker top, with a portion of the glass-ceramic plate broken away and omitted to show underlying structural details otherwise hidden thereby.
Figure 2:
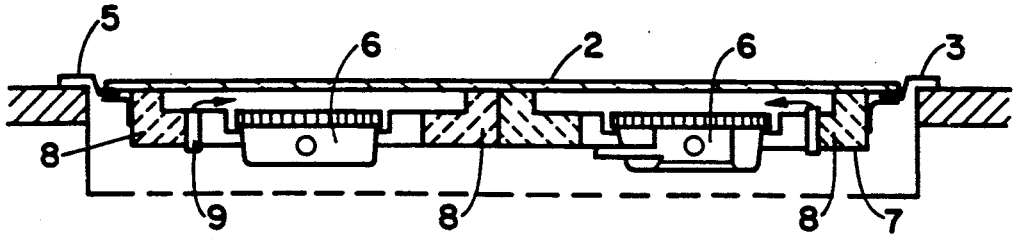
FIG. 2 shows a vertical transverse cross sectional view of the cooker top of FIG. 1.
Figure 3:
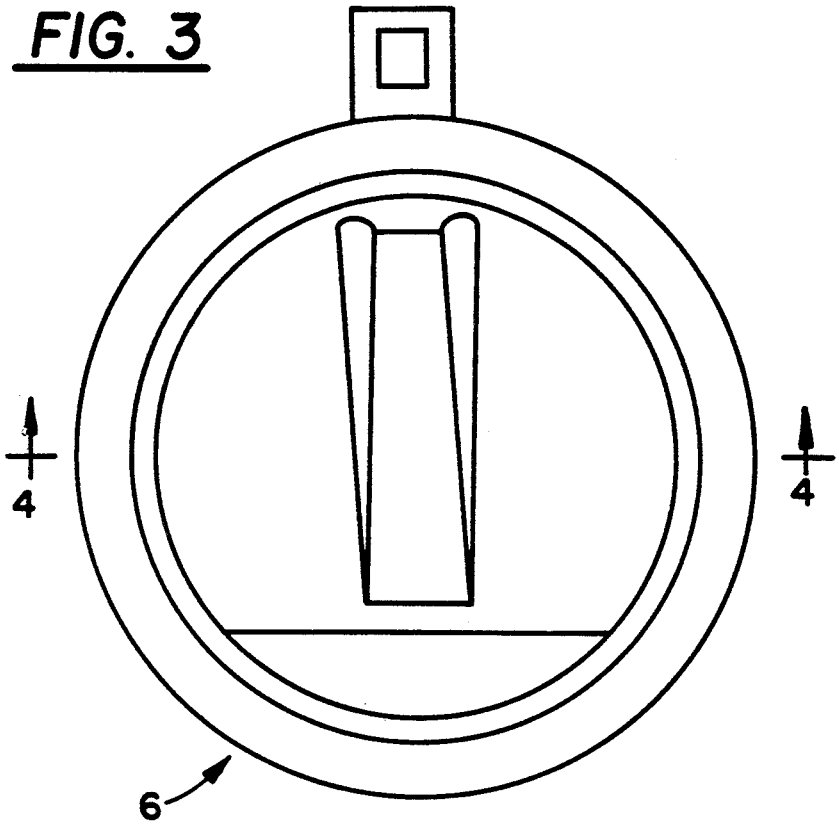
FIG. 3 shows a diagrammatic top plan view of a burner of the cooker top of FIGS. 1 and 2.
Figure 4:
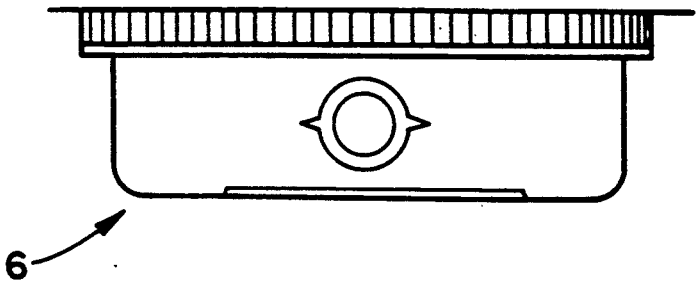
FIG. 4 shows a vertical transverse sectional view of the burner, taken on line IV—IV of FIG. 3.
Figure 5:
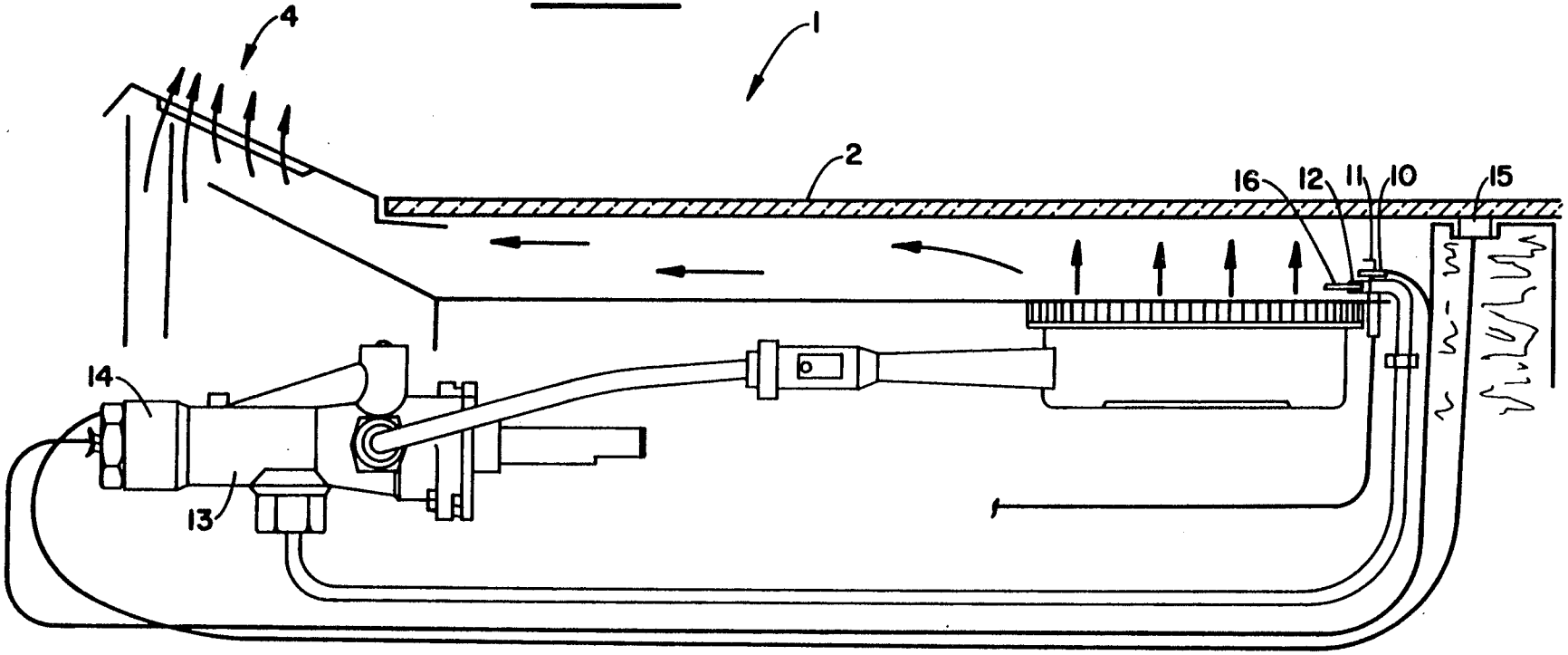
FIG. 5 shows a vertical transverse sectional view cross of the cooker top of FIG. 1–4.

With reference to the FIGURES, the glass-ceramic cooker top 1 of the illustrated preferred embodiment of the present invention includes a glass-ceramic pane or plate 2 arranged on a metal frame 3 with slots 4 for combustion product output, and in whose frame are notches 5 for the support and positioning of the glass-ceramic pane.

Below plate 2 are burners 6 located a plurality of each of which is fixed to base 7 with screws. Between the two burners 6 and the base 7, there is provided a layer of ceramic fibre heat insulation material 8.

Near the front of the cooker top as shown in top plan in FIG. 1, in one corner, are shown a pilot light 9 for a burner 6, the end of a thermocouple, 10 electrode 11 of a so-called permanent pilot light 12, and a thermostatic valve 13 equipped with magnetic unit 14.

Thermostatic valve 13 has a bulb 13 15 which is in contact with the lower side of the glass-ceramic plate 2. Although not illustrated, each burner 6 is similarly served by a set of elements 9–14, or shares such a set with another burner. In each set of elements 9–14 each burner, there is provided a filament 16 which is heated by the of the respective pilot light 9, and, when so heated, is visible through the glass-ceramic plate 2.

The method of lighting the pilot flame is carried out in a classic manner. That is to say, a respective control button located on the usual control panel, e.g., illustrated at the front (bottom) in FIG. 1, is placed in the lighting position and pressed down, followed by activation of the piezoelectric system until the respective light 9 is lit, thereby providing the flame which heats the respective thermocouple 10, the valves of magnetic unit 14 being maintained open.

The flaming gas of the pilot light heats and thus turns the filament 16 red, and is used to light the burner in each cycle carried out. Once a respective pilot light is lit, the control button is placed in the desired use position, turning on the burner and turning it off when the temperature of the glass-ceramic plate in the overlying vicinity of the respective burner reaches the thermostat operating level, by shutting off the flow of gas to the respective burner. However, the illuminated condition of the respective pilot light 9 is maintained, in order to reproduce the lighting operation, when the temperature of bulb 15 has been sufficiently reduced.

I claim:

1. A glass-ceramic gas cooker top, comprising:

a frame:

a generally horizontally disposed glass-ceramic plate having an upper face providing a cooking surface and a lower face, said plate being supported on said frame, said plate having at least one translucent region;

at least one gas burner disposed in vertically spaced underlying relation to said lower face of said plate, said gas burner being supported on said frame;

a manually setable, thermostatic valve operatively connected to said gas burner for alternatively supplying gas to said burner at a given rate and supplying no gas to said burner;

means for venting combustion gas, produced by said gas burner under said plate, to externally of said gas cooker top;

a sensory bulb disposed in contact with said lower face of said plate at a site adjacent said burner and operatively connected with said thermostatic valve for opening said valve, when said valve has been set to a selected temperature, for supplying gas to said burner only when said plate at said site is sensed by said bulb to have a temperature that is lower than said selected temperature; and means for lighting said burner when gas is supplied thereto by said thermostatic valve; said lighting means including:

a pilot light;

means for supplying gas to said pilot light;

a piezoelectrically operated igniter juxtaposed with said pilot light;

a control actuable for initiating supply of gas via said supplying means to said pilot light and operating said igniter for lighting said pilot light; and a filament juxtaposed with said pilot light, said burner and said translucent region of said plate, for being heated to a glowing condition by said pilot light when said pilot light is lit, for providing, to be visible from above said plate through said translucent region, a glowing indication that said pilot light is lit, and for lighting gas supplied to said burner by said thermostatic valve;

said means for supplying gas to said pilot light further including means associated with said thermostatic valve for preventing supply of gas to said burner unless said pilot light has become lit as a result of actuation of said control.

2. The cooker top of claim 1, wherein:

said piezoelectrically operated igniter includes a gas-fired permanent pilot light supplying heat for powering said piezoelectrically operated igniter.

* * * * *